US007661850B2

(12) United States Patent
Hsu et al.

(10) Patent No.: US 7,661,850 B2
(45) Date of Patent: Feb. 16, 2010

(54) DECORATION PLATE

(75) Inventors: Jung-Hui Hsu, Sinjhuang (TW); Hung-I Wu, Banciao (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 7 days.

(21) Appl. No.: 12/219,966

(22) Filed: Jul. 31, 2008

(65) Prior Publication Data

US 2009/0273929 A1 Nov. 5, 2009

(30) Foreign Application Priority Data

Apr. 30, 2008 (TW) ..... 97115916 A

(51) Int. Cl.
*F21V 9/00* (2006.01)
*G09F 13/00* (2006.01)

(52) U.S. Cl. ..... 362/351; 362/257; 362/317; 362/311

(58) Field of Classification Search ..... 362/351, 362/257, 317, 311; 40/427, 442, 444
See application file for complete search history.

(56) References Cited

U.S. PATENT DOCUMENTS

| | | | | |
|---|---|---|---|---|
| 6,158,156 | A * | 12/2000 | Patrick | 40/443 |
| 6,965,196 | B2 * | 11/2005 | Murasko et al. | 313/506 |
| 7,396,147 | B2 * | 7/2008 | Munro | 362/351 |
| 7,497,604 | B2 * | 3/2009 | Kleber et al. | 362/506 |
| 2007/0241553 | A1 * | 10/2007 | Heim et al. | 283/91 |

* cited by examiner

*Primary Examiner*—Jacob Y Choi
(74) *Attorney, Agent, or Firm*—Rosenberg, Klein & Lee

(57) ABSTRACT

A decoration plate includes a transparent substrate; an opaque ink layer provided on a portion of the transparent substrate surface, so that the transparent substrate has a plurality of transparent regions and opaque regions; a deep color transparent ink layer provided on the transparent regions of the transparent substrate; and a multicolor transparent ink layer provided on the deep color transparent ink layer, the transmittance of the multicolor transparent ink layer regarding light being larger than that of the deep color transparent ink layer. Via this arrangement, after the light is transmitted via the transparent regions of the decoration plate, the transparent regions will exhibit different colors.

7 Claims, 5 Drawing Sheets

DECORATION PLATE

BACKGROUND OF THE INVENTION

1. Field of the Invention

The present invention relates to a decoration plate, and in particular to a decoration plate having multicolor transparent inks.

2. Description of Related Art

Some symbols or patterns are often printed on a casing of an electronic product. Via these symbols or patterns, a user can be guided to understand how to operate the electronic product. For example, an arrow is printed on a button of an optical disk player, so that the user can be instructed to press the button thereby to play the optical disk. For another example, the vicinity of an insertion slot of a casing of a notebook computer will be indicated that such an insertion slot is suitable for which kind of electrical connector.

In order to make a user to recognize the symbols or patterns clearly even though the external light source is insufficient, the interior of the casing of the electronic product is provided with a light source module. The casing is made of a light-transmitting material and an opaque ink layer is coated on the surface of the casing. Then, the symbols or patterns are printed on the casing with transparent ink, so that the light emitted by the light source module can only be transmitted to the outside of the casing via the symbols or patterns. Taiwan Patent Publication No. 200632623 (published on Sep. 16, 2006) discloses a computer casing, in which a light source module is provided for allowing the emitted light to be transmitted to the outside of the computer casing. The light-transmitting mechanism of the casing not only makes the user easy to recognize the symbols or patterns on the casing, but also makes the external appearance of the electronic product more shining.

However, the light-transmitting mechanism of the conventional casing can only allow a monochromatic light to be transmitted. The symbols or patterns on the casing cannot exhibit different colors. Although a manufacturer attempts to provide several sets of light source modules of different colors in the casing thereby to generate multicolor lights, the multiple sets of light source modules may interfere with the arrangement of other electronic elements and increase the manufacture cost of the electronic product. Therefore, the above-mentioned measure can be limiting.

Consequently, because of the above limitation resulting from the technical design of prior art, the inventor strives via real world experience and academic research to develop the present invention, which can effectively improve the limitations described above.

SUMMARY OF THE INVENTION

The object of the present invention is to provide a decoration plate. A portion of the decoration plate can transmit light, and different colors of light can be transmitted by respective regions.

In order to achieve the above objects, the present invention provides a decoration plate, which includes a transparent substrate; an opaque ink layer provided on a portion of the transparent substrate surface, so that the transparent substrate has a plurality of transparent regions and opaque regions; a deep color transparent ink layer provided on the transparent regions of the transparent substrate; and a multicolor transparent ink layer provided on the deep color transparent ink layer, the transmittance of the multicolor transparent ink layer regarding light being larger than that of the deep color transparent ink layer.

The present invention has advantageous features as follows. Light can be transmitted via the transparent regions of the decoration plate. Furthermore, when the light source is weak, the deep color transparent ink layer makes the transparent regions and opaque regions of the decoration plate undistinguishable, thereby hiding the transparent regions. When the strength of light is sufficient, the light can be transmitted via the multicolor transparent ink layer, so that the respective region of the decoration plate can exhibit different colors.

In order to further understand the characteristics and technical contents of the present invention, a detailed description relating thereto will be made with reference to the accompanying drawings. However, the drawings are illustrative only, but not used to limit the scope of the present invention.

DETAILED DESCRIPTION OF THE PREFERRED EMBODIMENTS

Figure 1:
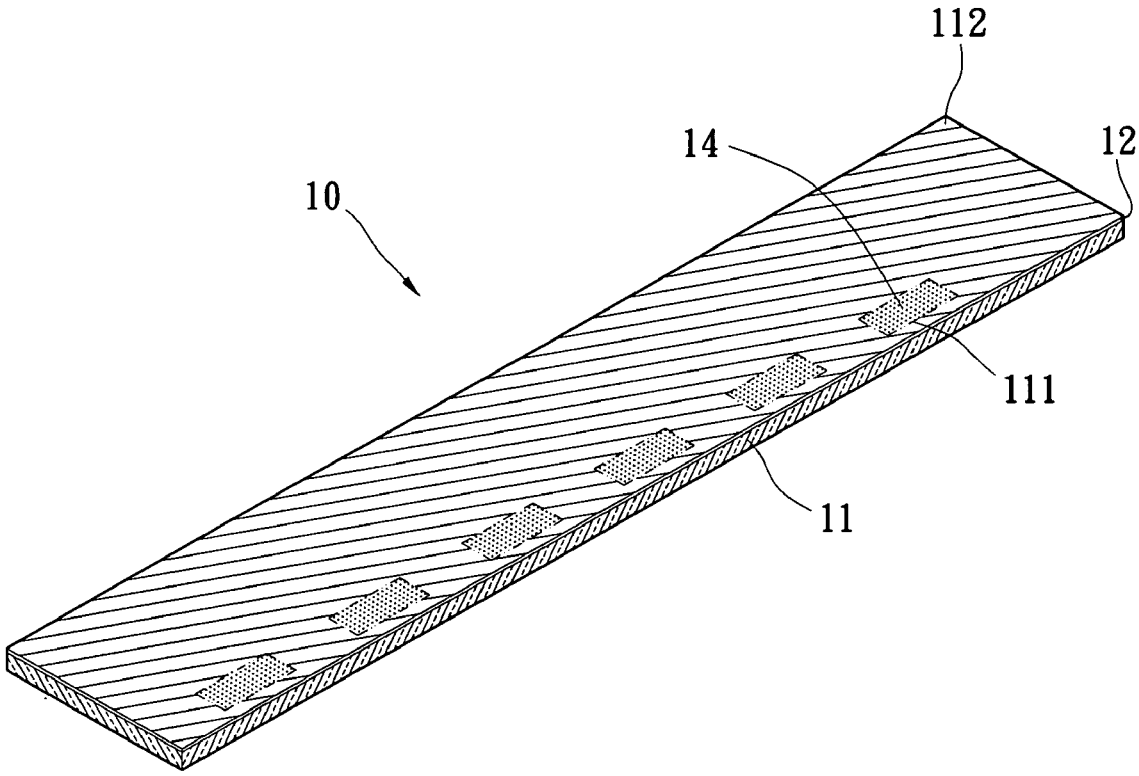
FIG. 1 is a perspective view showing the decoration plate of the present invention.
Figure 2:
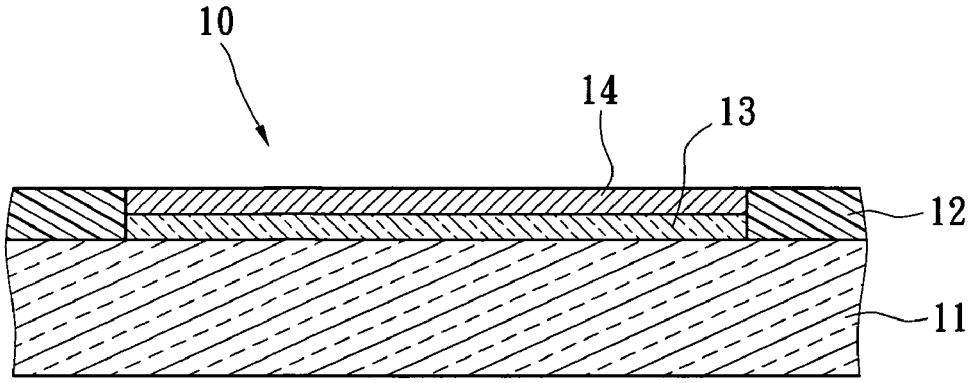
FIG. 2 is a cross-sectional view showing the decoration plate of the present invention.

Please refer to FIGS. 1 and 2. The decoration plate 10 of the present invention includes a transparent substrate 11, an opaque ink layer 12, a deep color transparent ink layer 13 and a multicolor transparent ink layer 14.

The transparent substrate 11 is made of a transparent material such as acryl, plastic or the like. The transparent substrate 11 may be colorless or has a specific color based on different uses. In the present embodiment, the transparent substrate 11 is colorless.

The opaque ink layer 12 is coated on a portion of the transparent substrate 11 surface and is fixed on the transparent substrate 11 after drying. The opaque ink layer 12 is to block the light from transmitting the portion of the transparent substrate 11 surface that has been coated by the opaque ink layer 12. Furthermore, the transparent substrate 11 has a plurality of transparent regions 111 and opaque regions 112. The transparent regions 111 can be manufactured into specific patterns, characters or numerals based on the demands of manufacturers.

The deep color transparent ink layer 13 is coated on the transparent region 111 of the transparent substrate 11 and is fixed on the transparent substrate 11 after drying. The "deep color" of the deep color ink layer 13 means the color of low transmittance regarding light: such as gray, black or deep blue. Therefore, when the light is weaker, the user cannot observe whether the light is transmitted via the transparent region 111, which makes the transparent region 111 and the opaque region 112 undistinguishable and achieves the effect of hiding the transparent regions 111.

The multicolor transparent ink layer 14 is coated on the deep color transparent ink layer 13 and is similarly fixed on the deep color transparent ink layer 13 after drying. The transmittance of the multicolor transparent ink layer 14 regarding light is larger than that of the deep color transparent ink layer 13. When the light passes through the multicolor transparent ink layer 14, the strength of light will not be reduced significantly. Furthermore, the multicolor transparent ink layer 14 has inks of at least one color, wherein different colors are coated on different transparent regions 111. Therefore, when the strength of light is sufficient, the user can observe that the light is transmitted via the transparent region 111 of the transparent substrate 11. The multicolor transparent ink layer 14 allows respective transparent regions 111 to exhibit different colors, thereby generating an aesthetic and shining effect.

Figure 3:
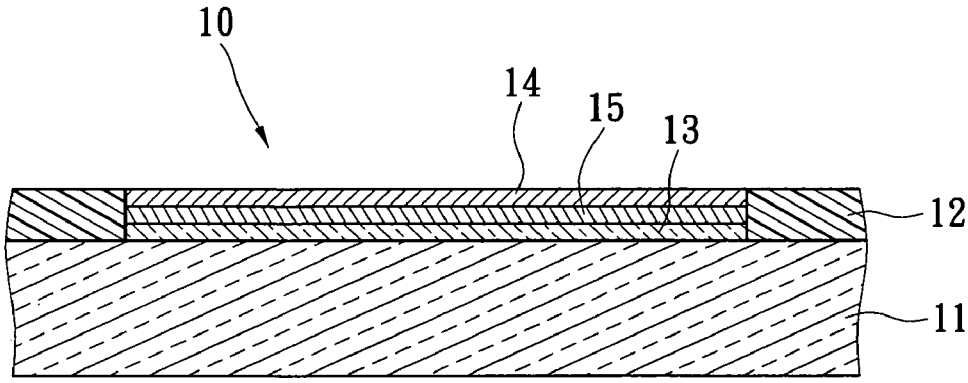
FIG. 3 is a cross-sectional view showing a second embodiment of the decoration plate of the present invention.

Please refer to FIG. 3, which shows a second embodiment of the present invention. For clarity, the identical reference numerals indicate the same elements of the present embodiment as those in the first embodiment. The difference between the second embodiment and the first embodiment is described as follows. In order to prevent the multicolor ink and the deep color ink from mixing to each other thereby change the properties thereof (such as transmittance or color) when the multicolor transparent ink layer 14 is coated on the deep color transparent ink layer 13, a transparent ink layer 15 will be coated on the deep color transparent ink layer 13 before the multicolor transparent ink layer 14 is coated on the deep color ink layer 13. Then, after the transparent ink layer 15 is dried and fixed, the multicolor transparent ink layer 14 is coated on the transparent ink layer 15. Thus, with the transparent ink layer 15, the multicolor transparent ink layer 14 can be avoided from contacting the deep color transparent ink layer 13 directly, and the problem that different inks may be mixed with each other will not occur.

The decoration plate 10 of the present invention furthermore has a third embodiment. The difference between the third embodiment and the first embodiment lies in the order of coating the multicolor transparent ink layer 14 and the deep color transparent ink layer 13. When the opaque ink layer 12 is coated on the transparent substrate 11 and is fixed thereon after drying, the multicolor transparent ink layer 14 is first coated on the transparent region 111, and the deep color transparent ink layer 13 is coated on the multicolor transparent ink layer 14. The effect generated by the third embodiment is the same as that of the first embodiment. Therefore, the transparent regions 111 can be hidden when the light is insufficient, whereas the transparent regions 111 exhibit different colors when the light is sufficient.

Furthermore, a transparent ink layer 15 can be coated between the multicolor transparent ink layer 14 and the deep color transparent ink layer 13 of the third embodiment.

The decoration plate 10 of the present invention further has a fourth embodiment. The difference between the fourth embodiment and the first embodiment lies in that the transparent substrate 11 is deep in color, thereby replacing the deep color transparent ink layer 13 of the previous embodiment. When the strength of light is insufficient, the user cannot observe whether the light is transmitted via the transparent substrate 111. Therefore, after the transparent substrate 11 is coated with the opaque ink layer 12, it is unnecessary to additionally coat a deep color transparent ink layer 13 on the transparent region 111, and instead, the multicolor transparent ink layer 14 can be coated on the transparent region 111 directly.

Figure 4:
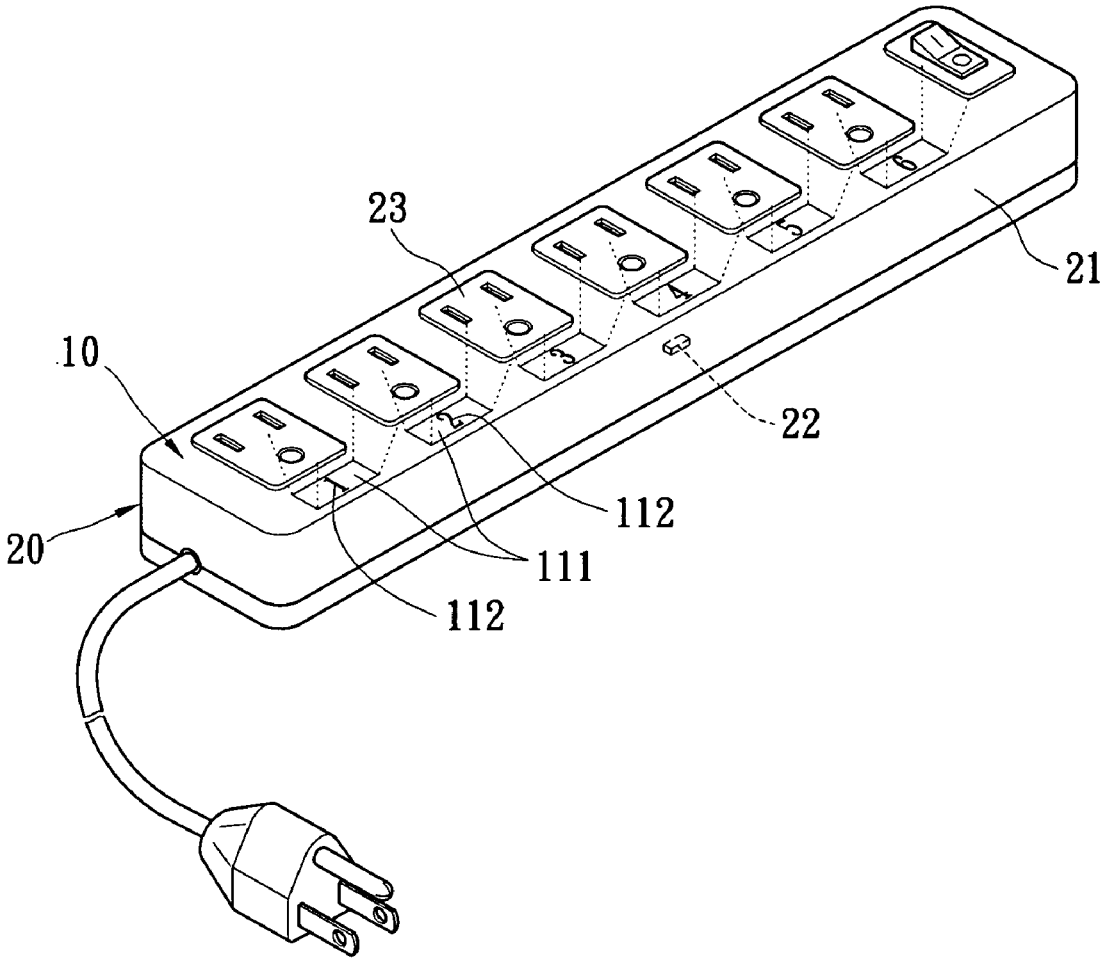
FIG. 4 is a schematic view showing the operating state of the decoration plate of the present invention.

Please refer to FIG. 4, which shows an application of the decoration plate 10 of the present invention. The decoration plate 10 is used to decorate the external appearance of an electronic product. In the present embodiment, a power strip 20 is shown as an example. The decoration plate 10 is disposed on a casing 21 of the power strip 20.

The upper side portion of the casing 21 is formed by the decoration plate 10. The interior of the casing 21 is provided with a light source module 22. The light source module is a light-emitting diode (LED) emitting a monochromatic light. The transparent regions 111 of the decoration plate 10 are distributed near a plurality of socket holes 23. Each of the transparent regions 111 is substantially formed into a rectangular shape. Each transparent region 111 has an opaque region 112. The profile of the opaque region 112 is formed into a numeral.

When the light source module 22 emits a light, the user can observe that the light is transmitted via the transparent region 111 and the respective transparent region 111 exhibits different colors, so that the casing 21 of the power strip 20 exhibits a more aesthetic visual effect. Furthermore, the color exhibited by the transparent region 111 is determined by the color of the multicolor transparent ink layer 14 on the transparent region 111 but not restricted by the color of light emitted by the LED.

Furthermore, part of the light of the transparent region 111 is shielded by the numeral-like opaque region 112, so that the transparent region 111 will display a numeral indicating the number of the socket hole 23, thereby guiding the user to insert a power plug into the socket hole 23 of a specific number.

Figure 5:
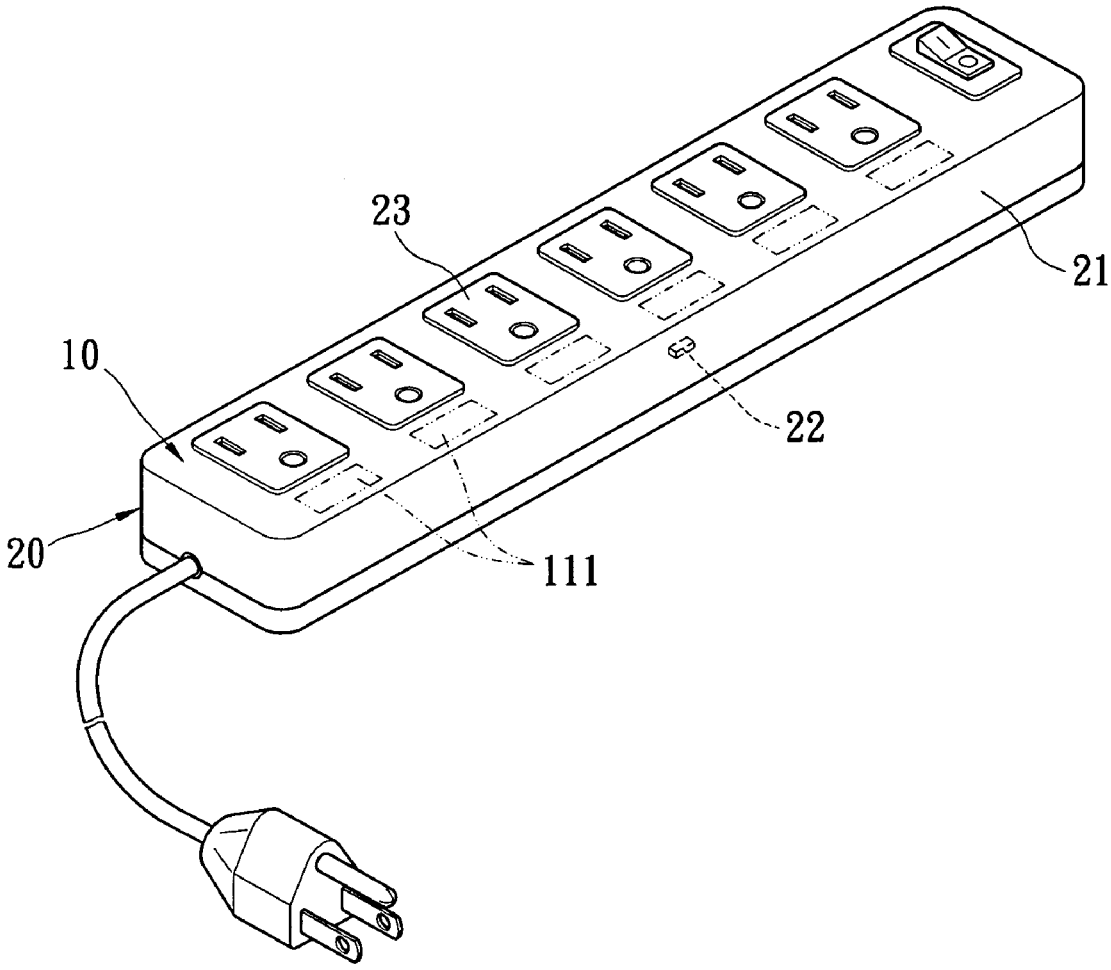
FIG. 5 is a schematic view showing another operating state of the decoration plate of the present invention.

Please refer to FIG. 5. When the light source module 22 does not transmit the light, the rectangular transparent region 111 and the number-like opaque region 112 (FIG. 4) seem undistinguishable from their external appearance, thereby achieving a visual effect of hiding the transparent region 111 of the decoration plate 10.

Figure 6:
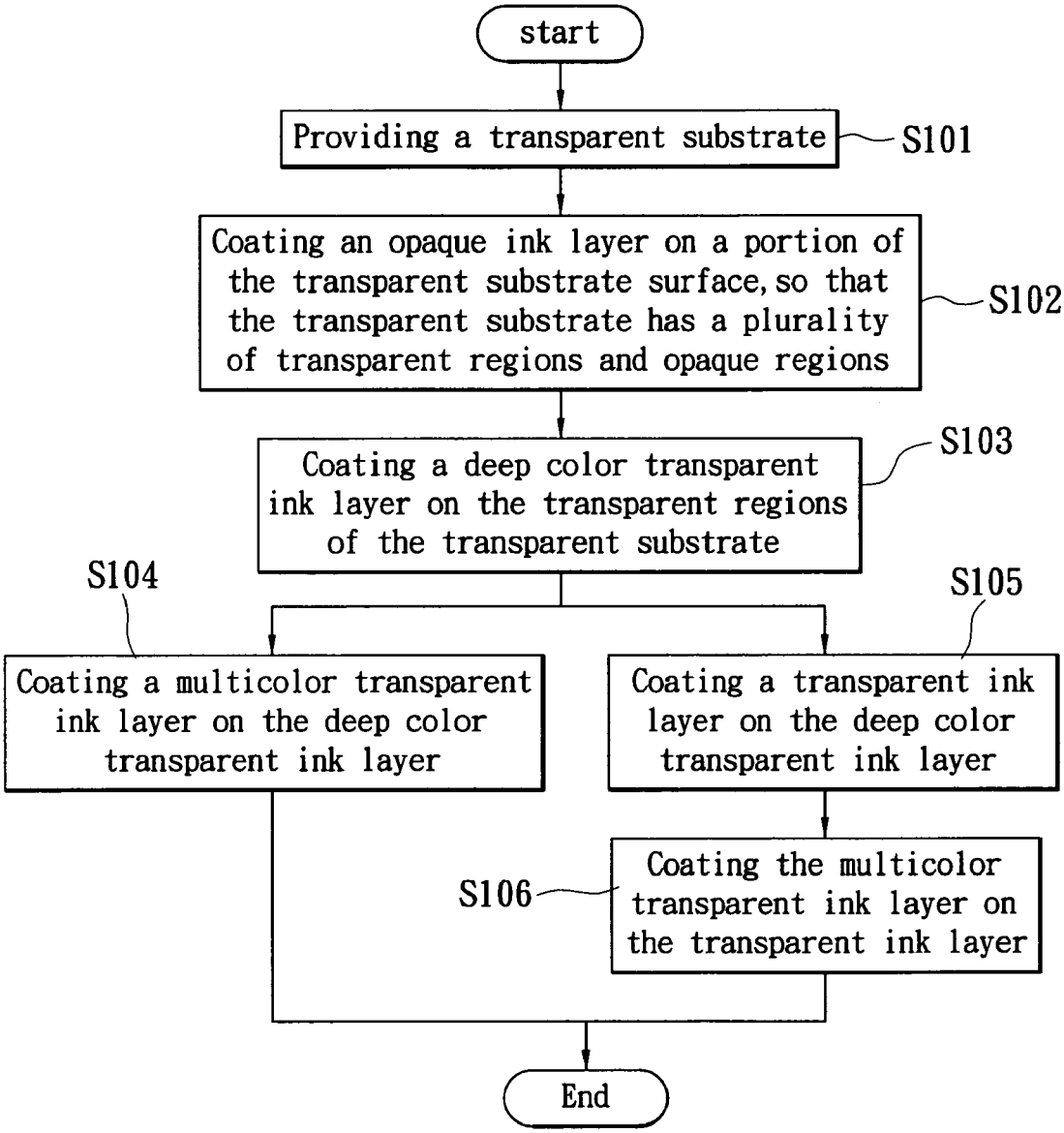
FIG. 6 is a flow chart showing a method for manufacturing the decoration plate of the present invention.

Please refer to FIG. 6 and also FIGS. 1 and 2. The method for manufacturing the decoration plate 10 of the first embodiment is described as follows.

In the step S101, a transparent substrate 11 is provided.

In the step S102, a portion of the transparent substrate 11 surface is coated with an opaque ink layer 12 and is dried by means of air drying or baking. Thereafter, the transparent substrate 11 will be formed into a plurality of transparent regions 111 and opaque regions 112.

In the step S103, a deep color transparent ink layer 13 is coated on the transparent region 111 of the transparent substrate 11 and is dried thereon. The color of the deep color transparent ink layer 13 may be gray, black, deep blue or other colors with lower transmittance regarding light.

In the step S104, a multicolor transparent ink layer 14 is coated on the deep color transparent ink layer 13. After drying, the manufacture of the decoration plate 10 is completed. The transmittance of the multicolor transparent ink layer 14 regarding light is larger than that of the deep color transparent ink layer 13. The multicolor transparent ink layer 14 has inks of at least two colors and is coated on different transparent regions 111.

Please refer to FIG. 3. The method for manufacturing the second embodiment of the decoration plate 10 is similar to that of the first embodiment and both of these two methods have the same steps of S101 to S103. The only difference lies in the last step S105, in which a transparent ink layer 15 is coated on the deep transparent ink layer 13, and after drying, a multicolor transparent ink layer 14 is coated on the transparent ink layer 15.

According to the above, the decoration plate 10 of the present invention has advantageous effects as follows. The light can be transmitted via the transparent regions 111 of the decoration plate 10. When the light is weak, the deep color transparent ink layer 13 makes the transparent regions 111 and opaque regions 112 undistinguishable, thereby hiding the transparent regions 111. When the strength of light is sufficient, the light is transmitted via the multicolor transparent ink layer 14, so that respective transparent region 111 of the decoration plate can exhibit different colors.

While the present invention has been described in terms of what is presently considered to be the most practical and preferred embodiments, it is to be understood that the present invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A decoration plate, comprising:

a transparent substrate;

an opaque ink layer provided on a portion of the transparent substrate surface, so that with the transparent substrate has a plurality of transparent regions and opaque regions;

a deep color transparent ink layer provided on the transparent regions of the transparent substrate; and a multicolor transparent ink layer provided on the deep color transparent ink layer, the transmittance of the multicolor transparent ink layer regarding light being larger than that of the deep color transparent ink layer.

2. The decoration plate according to claim 1, wherein the decoration plate further comprises a transparent ink layer provided between the deep color transparent ink layer and the multicolor transparent ink layer.

3. The decoration plate according to claim 1, wherein the multicolor transparent ink layer has inks of at least one color.

4. The decoration plate according to claim 1, wherein the transparent substrate is colorless.

5. The decoration plate according to claim 1, wherein the color of the ink of the deep color transparent ink layer is gray, black or deep blue.

6. The decoration plate according to claim 1, wherein the decoration plate is disposed on a casing of an electronic product, the casing of the electronic product has therein a light source module, and the light emitted by the light source module is transmitted via the transparent regions of the decoration plate.

7. The decoration plate according to claim 6, wherein the electronic product is a power strip.

* * * * *